United States Patent [19]

Salomatin et al.

[11] 4,276,727

[45] Jul. 7, 1981

[54] TELESCOPIC JIB FOR LOAD-HANDLING DEVICE

[76] Inventors: Viktor M. Salomatin, Kastanaevskaya ulitsa, 44, kv. 58; Petr N. Belyanin, ulitsa Marshala Tukhachevskogo, 23, korpus 2, kv. 186; Vladimir I. Pestrikov, Profsojuznaya ulitsa, 59/25, korpus 2, kv. 79, all of Moscow, U.S.S.R.

[21] Appl. No.: 940,152

[22] Filed: Sep. 5, 1978

[30] Foreign Application Priority Data

Dec. 6, 1977 [SU] U.S.S.R. ..... 2546701

[51] Int. Cl.[3] ..... B66C 23/06

[52] U.S. Cl. ..... 52/115; 52/118

[58] Field of Search ..... 52/148, 149, 115, 118; 277/189, 58

[56] References Cited

U.S. PATENT DOCUMENTS

| | | | |
|---|---|---|---|
| 842,799 | 1/1907 | Monroe | 52/115 |
| 2,689,025 | 9/1954 | Yates | 52/115 |
| 3,606,713 | 9/1971 | Runquist | 52/1 X |
| 3,642,289 | 2/1972 | Basham et al. | 277/58 X |

*Primary Examiner*—Price C. Faw, Jr.
*Assistant Examiner*—Carl D. Friedman
*Attorney, Agent, or Firm*—Haseltine and Lake

[57] ABSTRACT

A telescopic jib of a load-handling device, having telescopically extensible sections in the form of fluid cylinders. An annular sealing assembly is employed at the end portions of the sections, in the form of a sleeve which defines an annular space with the end face of the fluid cylinder of greater diameter and the side surface of the fluid cylinder of smaller diameter. A floating ring is mounted in the annular space and has seals which engage the external periphery of said smaller-diameter fluid cylinder and the end faces of the floating ring. Annular grooves are coaxial in the external peripheral surface at the end of each said fluid cylinder and in the end face of the respective one of said sleeves such that, a support ring is accommodated in each pair of annular grooves. A rope-and-sheave system having at least two runs symmetrically extending with respect of the longitudinal axis of the jib is used to govern the motion of the sections.

1 Claim, 2 Drawing Figures

TELESCOPIC JIB FOR LOAD-HANDLING DEVICE

The present invention relates to load-handling devices, and more particularly it relates to telescopic jibs adapted to handle loads in association with manufacturing plant, as well as for other purposes.

The present invention can be utilized to utmost effectiveness for solving the problems of load-handling in crowded or constricted premises, such as production shops, warehouses, urban utility services, stores of supermarkets, in agriculture, and also under conditions hazardous for human's health, such as in chemical plants and nuclear power plants, e.g. for placing work onto processing machines, for charging furnaces, cargo elevators, etc.

The need for creating the apparatus of the herein disclosed type has been brought about by the increasing demand of the manufacturing industries for means of mechanisation of the main and auxiliary operations of production and transportation, particularly, in cases of hard or monotonous, hazardous or obstructed working environment, where various loads weighing 16 kilos and more are to be handled.

A telescopic jib is an integral part of various load-handling devices, cranes and manipulators. The present-day requirements put before devices of this kind include the capability of accurate delivery of indexed articles to the working zones of various production plant with restricted access, the manueverability in crowded premises, the sufficient inherent ability of these devices of varying their own dimensions, such as a combination of the compact initial size if a device and its ability to have a considerable outreach whenever required, and the modest specific amount of metal in their structures.

The design of the jib is a major consideration, if a device of the herein discussed type is to meet the above requirements.

There is known a telescopic jib for a load-handling device (see the SU Inventor's Certificate No. 347,292; Int.Cl. B 66 c23/14, dated 1972). This jib includes an external section and an internal section, and is provided with a fluid cylinder having one its end secured to the external section and its other end secured to the extensible internal section of the "Nuremberg shears" type.

There is also known a telescopic jib for a manipulator (see the SU Inventor's Certificate No. 555,007; Int.cl.$^2$ B 25 J 11/00; B 66 C 23/14, dated 1977), which, same as the abovedescribed one, includes a stationary external section and an extensible internal section, interconnected by a fluid cylinder. However, the abovedescribed type of telescopic jibs offer but small transformability of their size, limited by the length of the fluid cylinder and of its projectable section, i.e. the piston and its rod. In the complicated service conditions of the load-handling devices, requiring a greater transformability of the size, both for better maneuverability and for saving the production space, the abovedescribed designs of telescopic jibs are a worse choice than a design of a telescopic jib having more than one extensible section.

Some of the designs of telescopic jibs incorporate means for preventing bending of the telescopic cylinder of the telescopic jib. Thus, in the structure disclosed in the JA Pat. Nos. 47-46098 and 47-48099, Nat.Cl. 83 F 2, there is the rod of, a telescopic cylinder mounted in the telescopic jib including an external tube and an internal tube telescopically received in the external one. The rod receives thereabout a freely slidable device for preventing the lateral bending, having a portion which at sliding or turning engages the internal surface of the tube. The device also carries an arrangement associated with replaceable retaining elements capable of locking the internal tube and the front end of the cylinder in various intermediate positions.

However, the abovedescribed device is incapable of completely eliminating the lateral bending, and thus is inadequately effective. By its structure the device is something like another link of the telescopic cylinders, complicating the overall design and increasing the weight of the jib.

The telescopic jib disclosed in the SU Inventor's Certificate No. 447,352, Int.Cl.$^2$ B 66 C 23/68, dated 1974, includes a stationary section, two movable sections and an extension piece retainable relative to one of the movable sections either in the retracted position or in the projected one.

The projection of one of the movable sections relative to the other one, and of the extension piece relative to the respective one of the movable sections are effected by the effort of a triple-stage telescopic hydraulic cylinder comprising a housing, a rod and a plunger. The projection of the movable section relative to the stationary section is effected by an auxiliary hydraulic cylinder.

The end portion of the enclosing part of each one of the hydraulic cylinders has mounted therein an annular seal. To control and govern the extension of the sections, the jib incorporates a rope-and-sheave system of which the sheaves are offset with respect to the longitudinal axis of the jib and are supported by one of the movable sections.

Among the drawbacks of this design of the jib are the incorporation of the triple-stage hydraulic cylinder and of the auxiliary cylinder, complicating the structure, and the necessity of providing additional supports and guides of the movable sections.

The support of the enclosing section, serving as a kind of a root of the enclosed section, is the area most loaded by the lateral bending torque; therefore, at the area where the enclosed section projects from the enclosing section there is generated the greatest strain which has to be compensated by the massive cross-section of the sections throughout their length, which increases the weight of the jib. The rods of the telescopic hydraulic cylinder are associated with a sealing assembly not designed to withstand the lateral bending, which eventually affects the reliability of the fluid-tight sealing.

It is an object of the present invention to simplify the structure of the telescopic jib.

It is another object of the present invention to reduce the weight of the telescopic jib.

It is yet another object of the present invention to improve the transformability of the size of the telescopic jib.

These and other objects are attained in a telescopic jib for load-handling devices, comprising telescopically extensible sections of which the end portions are provided with annular seals, and a synchronising gear governing the motion of the sections and including a rope-and-sheave system, in which jib, in accordance with the present invention, the said sections include fluid cylinders, the end portion of each fluid cylinder having a sleeve defining with the end face of the fluid cylinder of the greater diameter and with the side surface of the fluid cylinder of the smaller diameter an annular space accommodating a floating ring with seals adapted to engage the external periphery of the smaller cylinder and the end faces of said floating ring, the external periphery of the end portion of each fluid cylinder and the end face of the sleeve having made therein coaxial grooves accommodating a support ring, the rope-and-sheave system of the synchronising gear including at least two rope runs symmetrically arranged with respect to the longitudinal axis of the jib.

With the sections of the jib being actually in the form of fluid cylinders, the structure of the jib has become simplified, while the load-carrying capacity of the jib is maintained by the herein disclosed structure of the sealing assembly of the sections, the provision of the support ring, and the symmetric arrangement of the rope-and-sheave system relative to the longitudinal axis of the jib, with the rope in this system being permanently maintained taut.

The support ring has been incorporated to strengthen up the most loaded portion of the jib, by generating the initial strain compressing the internal cylinder and expanding the external one. The annular sealing being provided by the ring freely floatable relative to each respective enclosing section makes the working conditions of the sealing assembly independent from the relative positions of the sections taking up the bending loads. Neither would the single-sided engagement of the rod with the fluid cylinder and their wear in operation affect the fluid-tightness of the sealing assembly, as the latter is associated with but one cylindrical surface of the enclosed section. Furthermore, the rope-and-sheave system acts not only as the means of timing and governing the relative motion of the sections, but also as the means enhancing the rigidity of the jib, since the system is symmetrical with respect of the longitudinal axis of the jib. In the preferred embodiment the end of the jib carries a driving sheave or pulley over which runs the rope having one its end secured to a drum and its other end secured to the root portion of the jib. With the rope-and-sheave system so arranged relative to the axis of the jib being tensioned, the tensioning affort being directed toward the root portion of the jib, there are created conditions under which the tensioning effort follows the root portion of the jib, for the bending torque at the jib attachment area to be close to the zero value. The load-carrying capacity of the jib, owing to the herein disclosed novel structure of all the major jib components, has been stepped up more than twice, while the weight of the jib has been reduced accordingly, and there has been eliminated the need in additional supports and fluid cylinders adapted to transmit the motion to the movable sections of the jib.

Other objects and advantages of the present invention will be made apparent in the following description of an embodiment thereof, with reference being had to the accompanying drawings, wherein.

Figure 1:
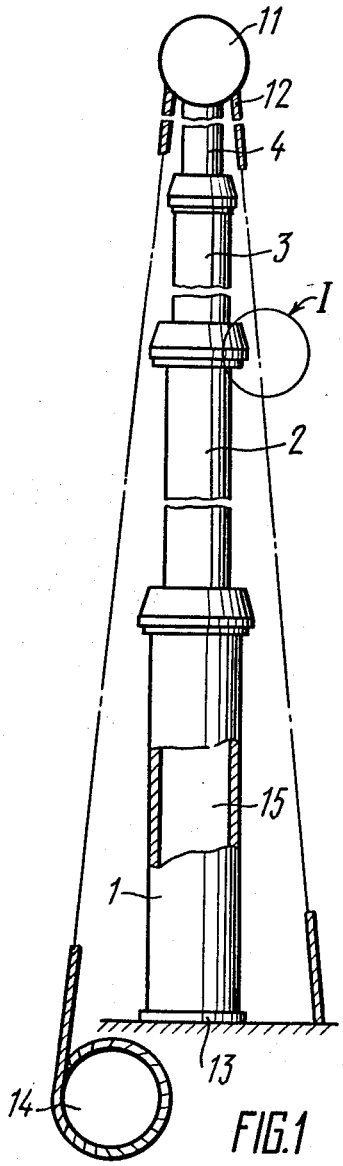
FIG. 1 is the general view of the telescopic jib embodying the invention.
Figure 2:
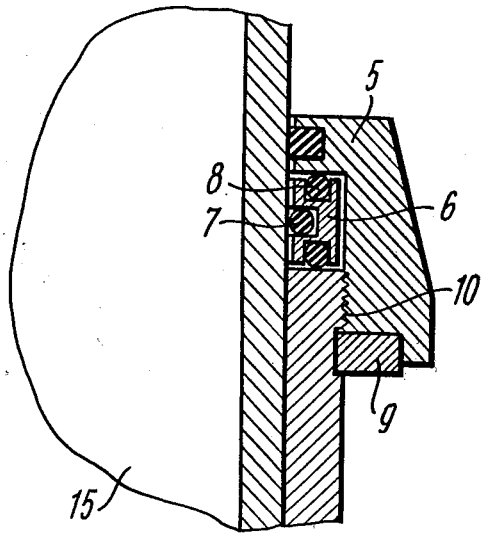
FIG. 2 is an enlarged longitudinally sectional view of the area of FIG. 1.

Referring now to the appended drawings, the herein disclosed jib comprises a relatively stationary section 1 (FIG. 1) and movable sections 2, 3 and 4 telescopically received for axial reciprocation in one another. Thus, the section 3 serves as the guiding one for the section 3; the section 2 acts the same role with respect of the section 3, and the section 1 with respect of the section 2. Each adjacent pair of the sections jointly defines a hydraulic cylinder 1, the hydraulic cylinders 1 acting as the drives effecting the motion of the respective sections 2, 3 and 4. In each adjacent pair of the sections in section of the greater diameter supports the section of the smaller diameter and receives on its end portion a sleeve 5 (FIG. 2) of the stepped internal diameter, defining with the end face of the enclosing section an annular space accommodating therein a floating ring 6 carrying annular or ring seals 7 and 8 of which one seal 7 engages the external periphery of the enclosed section, and the two seals 8 extend about the respective end faces of the ring 6. Made in the external periphery of each respective enclosed section and in the end face of the sleeve 5 are coaxial aligned grooves, each snugly receiving therein a support ring 9 enhancing rigidity of the support assembly and generating therein an initial strain. To broaden the range of the adjustment of this initial strain in the connection of the sections, the ring 9 is preferably shaped as a truncated cone. In the embodiment being described the sleeve 5 has a threaded connection 10 with the respective enclosing section.

The free end of the endmost section 4 has mounted thereon a rotatable driven sheave 11 of a sheave-and-rope system, with the rope 12 of the system running thereabout, one end of the rope 12 being secured to the root part 13 of the jib, and the other end being secured to a drum 14. The rope 12 runs along the outline of the jib symmetrically with respect of the longitudinal axis thereof, the sheave-and-rope system acting as the synchronising gear governing the motion of the sections 2, 3 and 4.

Running internally of the sections 1, 2, 3 and 4 throughout their length is a passage 15 into which the working fluid e.g. oil can be supplied under pressure.

The herein disclosed jib operates, as follows.

To project or extend the sections 2, 3 and 4 of the jib, the oil is fed into the passage 15 under pressure, and simultaneously oil under pressure is fed into one of the working spaces of a hydraulic motor (not shown) driving the drum 14. The oil is fed into the hydraulic motor at a continuous volume feed rate, which provides for a uniform velocity of the motion of the rope 12 and the permanent tensioning of this rope 12, so that the tensioning effort is transmitted as the axial restraining force to the sections 2, 3 and 4, i.e. the effort opposing and restraining their motion. Thus, the hydraulic motor synchronises or governs the motion of the rope 12. Apart from their function of effecting the motion of the movable sections of the jib, the hydraulic cylinders act as the support elements, the most critical cross-sectional areas being the support assembly at the end of each enclosing section, this assembly having been reinforced with the respective support ring 9 to enhance the rigidity. By ensuring the adequately snug fit of the rings 9, it is possible to attain the maximum rigidity of the entire structure.

In operation of the herein disclosed jib, there takes place some non-coaxially of the sections 2, 3 and 4 and their somewhat single-sided or biased engagement in the respective hydraulic cylinders. However, this eventual non-coaxiality has been fully provided for by the annular seals 7, 8 having been mounted on the floating rings 6 which are sufficiently free to move radially together with the section being sealed, which ensures the required fluid-tightness of the sections 1, 2, 3 and 4 and precludes the single-sided wear of the seals 7 and 8.

To retract the movable sections 2, 3, 4, the rope-and-sheave system is operated. This is done by connecting the passage 15 to drain, providing some draining counterpressure in the system (not shown), and switching over the working spaces of the hydraulic motor (not shown, either); the drum 14 being now rotated in the reverse direction.

What we claim is:

1. A telescopic jib of a load-handling device, comprising: telescopically extensible sections made in the form of fluid cylinders; annular sealing means positioned at the end portions of said sections, each said annular sealing means including a sleeve defining an annular space with the end face of the fluid cylinder of the greater diameter and the side surface of the fluid cylinder of the smaller diameter, a floating ring mounted in said annular space and carrying seals engaging the external periphery of said smaller-diameter fluid cylinder and the end faces of said floating ring; annular grooves made coaxially in the external peripheral surface at the end of each fluid cylinder and in the end face of the respective one of said sleeves; a support ring accommodated in each said pair of annular grooves; means for governing the motion of said sections, including a rope-and-sheave system having at least two runs symmetrically extending with respect of the longitudinal axis of said jib.

* * * * *